US010259223B2

(12) United States Patent
Verzijl et al.

(10) Patent No.: US 10,259,223 B2
(45) Date of Patent: Apr. 16, 2019

(54) PRINT HEAD HAVING A CHIP-CARRYING TILE WITH STRESS RELIEF PLATE

(71) Applicant: Océ Holding B.V., Venlo (NL)

(72) Inventors: Klaas Verzijl, Venlo (NL); Norbert H. W. Lamers, Venlo (NL); Henricus M. G. Simons, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 5 days.

(21) Appl. No.: 15/814,575

(22) Filed: Nov. 16, 2017

(65) Prior Publication Data

US 2018/0147843 A1 May 31, 2018

(30) Foreign Application Priority Data

Nov. 29, 2016 (EP) ..... 16201200

(51) Int. Cl.
*B41J 2/14* (2006.01)
*B41J 2/16* (2006.01)

(52) U.S. Cl.
CPC ..... *B41J 2/1433* (2013.01); *B41J 2/14233* (2013.01); *B41J 2/16* (2013.01); *B41J 2/1623* (2013.01); *B41J 2002/14362* (2013.01); *B41J 2202/08* (2013.01)

(58) Field of Classification Search
CPC ..... B41J 2/1433; B41J 2/1408; B41J 2/1623; B41J 2/16; B41J 2/14024; B41J 2202/08; B41J 2002/14362; B41J 2/14233
See application file for complete search history.

(56) References Cited

U.S. PATENT DOCUMENTS

2007/0279455 A1* 12/2007 Karlinski ..... B41J 2/14201 347/54
2008/0158297 A1 7/2008 Cha et al.
2014/0063130 A1* 3/2014 Arai ..... B41J 2/1433 347/70

FOREIGN PATENT DOCUMENTS

EP 0 587 346 A2 3/1994
JP 01148561 A * 6/1989 ..... B41J 2/195

OTHER PUBLICATIONS

Search Report issued in European Patent Application No. 16201200, completed May 8, 2017.

* cited by examiner

*Primary Examiner* — Henok D Legesse
(74) *Attorney, Agent, or Firm* — Birch, Stewart, Kolasch & Birch, LLP

(57) ABSTRACT

A print head has a tile made of a material having a first coefficient of thermal expansion (CTE). The tile carries a chip that forms a number of printing elements and is in thermal contact with the tile. The chip is mainly made of a material having a second CTE different from the first CTE. A stress relief plate is made of a material having a third CTE that is closer to the second CTE than the first CTE and is bonded to the tile with a first adhesive layer having a first thickness d1. The chip is bonded to the stress relief plate with a second adhesive layer having a second thickness d2 smaller than the first thickness d1.

12 Claims, 2 Drawing Sheets

PRINT HEAD HAVING A CHIP-CARRYING TILE WITH STRESS RELIEF PLATE

Figure 1:
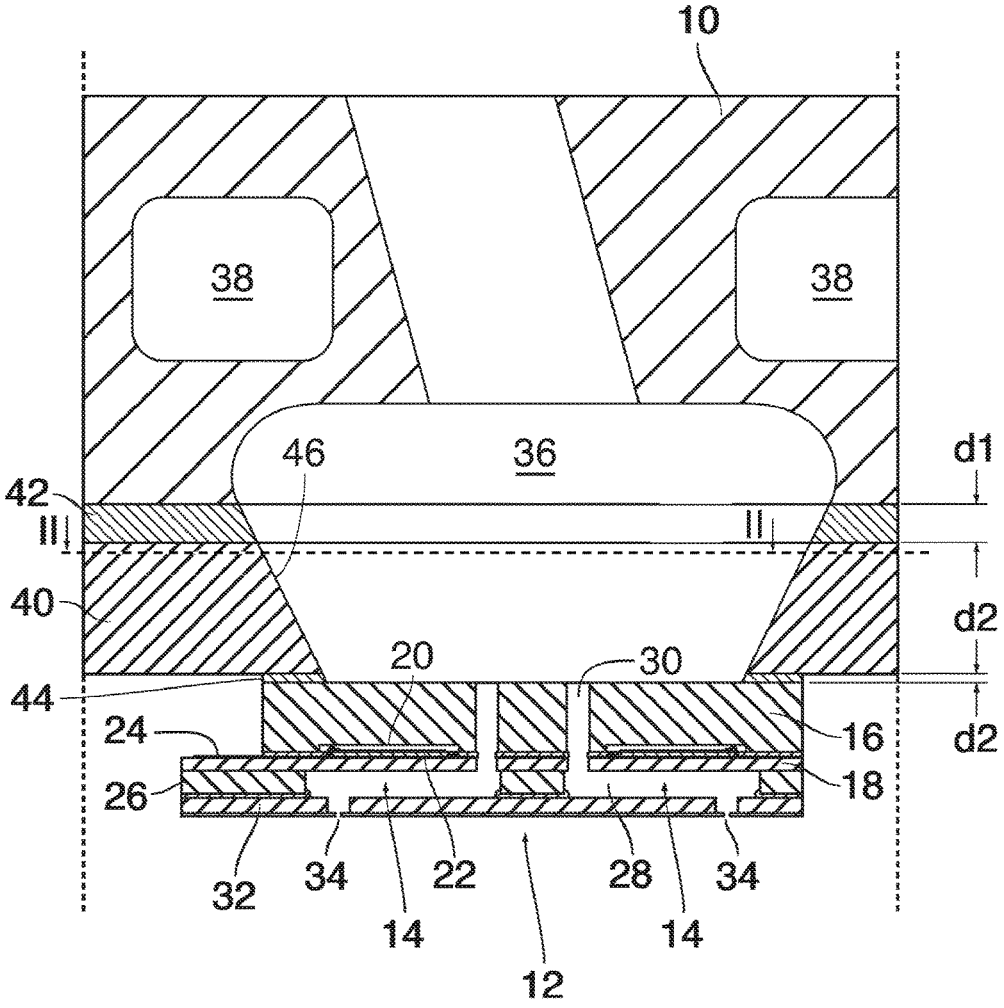

The invention relates to a print head having a tile made of a material having a first coefficient of thermal expansion (CTE), the tile carrying a chip that forms a number of printing elements and is in thermal contact with the tile, the chip being mainly made of a material having a second CTE different from the first CTE.

More particularly, the invention relates to an ink jet print head wherein the chip is a MEMS-chip (micro-electro-mechanical system).

Depending upon the type of print process, it is frequently required that the chip operates at a temperature that is different from room temperature so that the chip needs to be cooled or—in most cases—heated. Since it is not cost-effective to accommodate a heater on the chip due to e.g. surface area use, it is preferred that there is a good thermal contact between the chip and the tile so that the heater may be applied to the tile and the heat will then be transferred onto the chip.

On the other hand, the chip is required to have a relatively large window permitting to supply marking material such as ink to the printing elements. As a consequence, the chip can engage the tile only on a relatively small surface at the edge of the window, which compromises the heat transfer to the chip.

The chip is typically made of a material such as silicon or ceramics, whereas the tile may be made of a less expensive material such as graphite which, however, has a CTE that is substantially different from that of the chip. As a consequence, the tile and the chip are subject to differential thermal expansion which induces a mechanical stress in the chip. This mechanical stress may compromise the print quality. For example, in case of a piezoelectric ink jet print head, each printing element comprises a flexible membrane which is deflected by means of a piezoelectric actuator so as to create an acoustic pressure wave in the ink and thereby to cause an ink droplet to be expelled from a nozzle. The mechanical stress in the chip changes the tension of the membrane and thereby has an influence on the jetting behavior of the printing elements. Since the mechanical stress tends to be largest at the ends of an elongated chip, the result is a non-uniform jetting behavior of the printing elements and, consequently, a non-uniform appearance of the printed image.

In particular, in a process of applying the chip on the tile, an adhesive may be used that needs to be subjected to a heat treatment, e.g. for curing the adhesive. Such heat treatment usually includes heating to a treatment temperature different from the operating temperature of the print head. Thus, the chip and tile are fixed in their relative positions at said treatment temperature. Inevitably, at the operating temperature the mechanical stress will be present.

In order to reduce the mechanical stress, it is generally possible to bond the chip to the tile by means of a relatively thick layer of adhesive which can allow for differential thermal expansion of the tile and the chip and thereby reduce the mechanical stress. However, an increased thickness of the adhesive layer compromises the transfer of heat from the tile to the chip so that a reasonable compromise had to be made in conventional designs.

It is an object of the invention to provide a print head which can be manufactured at low costs and in which a good thermal contact between the tile and the chip can be achieved while reducing the mechanical stress in the chip.

In order to achieve this object, according to the invention, a stress relief plate made of a material having a third CTE that is closer to the second CTE than to the first CTE is bonded to the tile with a first adhesive layer having a first thickness, and the chip is bonded to the stress relief plate with a second adhesive layer having a second thickness smaller than the first thickness.

The first adhesive layer between the tile and the stress relief plate can extend over a relatively large area so that a good heat transfer can be achieved in spite of the relatively large thickness of this adhesive layer. The thickness of the first adhesive layer can therefore be made so large that this layer allows for differential thermal expansion of the tile and the stress relief plate. On the other hand, since the CTEs of the stress relief plate and the chip are identical or at least very similar, there will be no substantial differential thermal expansion between the stress relief plate and the chip, even when the temperature changes. The second adhesive layer between the stress relief plate and the chip can therefore be made so thin that a good thermal contact is achieved even though the second adhesive layer extends only over a relatively small area around the window in the stress relief plate.

Thus, by employing the stress relief plate, the invention permits to achieve both a good heat transfer and a reduced mechanical stress and, consequently a high print quality.

Preferred embodiments of the invention are indicated in the dependent claims.

In a practical embodiment, the tile may carry a plurality of chips, in particular MEMS-chips. In this case, the stress relief plate may extend over and carry a plurality of chips, which increases the area of contact between the stress relief plate and the tile.

The material of the stress relief plate may be the same as the main material of the chip, e.g. silicon or ceramics, whereas the tile may be made of graphite. The thickness of the stress relief plate may be considerably smaller than that of the tile, which permits a cost reduction without compromising the overall stability of the print head.

Figure 2:
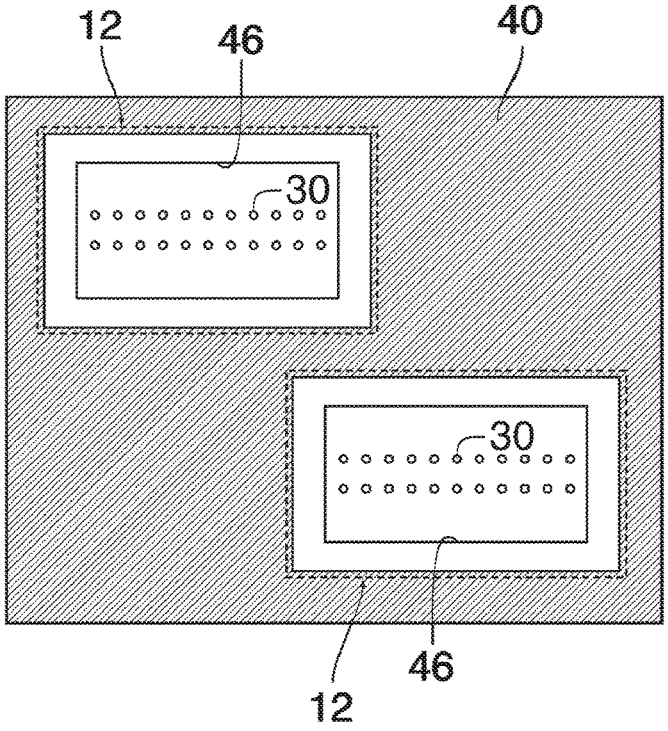

An embodiment example will now be described in conjunction with the drawings, wherein:

FIG. 1 is a cross-sectional view of a part of a print head according to the invention; and FIG. 2 is a sectional view taken along the line II-II in FIG. 1.

FIG. 1 shows a part of a print head comprising a tile 10 which is made of graphite and serves as a support structure for one or more MEMS-chips 12 each of which forms a plurality of piezoelectric ink jet printing devices 14. The printing devices 14 are arranged in two parallel rows extending normal to the plane of the drawing in FIG. 1, so that the cross-sectional view shows two of these printing elements. In practice, any number of rows may be present as is apparent to those skilled in the art.

As is well known in the art, the chip 12 has a substrate 16 made of silicon, and a flexible membrane 18 which is bonded to a bottom face of the substrate 16 so as to cover actuator chambers 20 that have been etched into the bottom face of the substrate 16. Each actuator chamber 20 accommodates a piezoelectric actuator 22 which is attached to the flexible membrane 18 and has electrodes electrically connected to a contacting section 24 of the chip 12.

Another silicon layer 26 of the chip 12 is bonded to the bottom face of the membrane 18 and forms a number of cavities 28 each of which is disposed opposite to one of the actuators 22. The cavities 28 are connected to ink supply passages 30 which penetrate the substrate 16. On the bottom side, the cavities 28 are delimited by a nozzle plate 32 which forms a number of nozzles 34 disposed such that each nozzle 34 is in fluid communication with the cavity 28 of one of the printing elements.

The tile 10 accommodates an ink supply manifold 36 for supplying liquid ink to the ink supply passages 30 of each of the printing elements 14.

The tile 10 further accommodates one or more heaters (or, more generally, temperature adjusting devices) 38 for heating the chips 12. In this example, it may be assumed that the printer is a hot-melt ink jet printer so that the chip 12 has to be heated to a temperature above the melting point of the ink when the printer is operating. A hot-melt inkjet printer may use any ink that requires heating to an elevated temperature to enable jetting of such ink. Hence, the ink may merely solidify after jetting to cure or the ink may form a gel after jetting and require further curing, e.g. by application of a curing radiation, as well known in the art. In any case, the present invention is not limited to a hot-melt ink application, but is directed at any print head operated at such an operating temperature that may cause mechanical stress due to a differential CTE.

Since the material of the tile 10 (graphite) has a coefficient of thermal expansion that is substantially larger than that of the material (silicon) of the substrate 16 of the chip 12, it is necessary to limit the mechanical stress that may be induced in the chip 12 due to differential thermal expansion, especially because such mechanical stress would affect the tension of the membrane 18 and, consequently, the jetting behavior of the printing elements. For this reason, a stress relief plate 40 is interposed between the tile 10 and the substrate 16 of the chip 12. The material of the stress relief plate 40 is selected such that the difference in the coefficient of thermal expansion between the chip 12 and the stress relief plate 40 is smaller than the difference in thermal expansion between the stress relief plate 40 and the tile 10. For example, the stress relief plate 40 may be made of the same material as the substrate 16 of the chips, i.e. silicon in this example.

For good temperature control of the chip 12, it may be preferred that the stress relief plate 40 has a good thermal conductivity. Heat applied by the heaters 38 may thus easily reach to the chip 12, but at least as important the good thermal conductivity further ensures an even spread of the heat over the stress relief plate 40 and thus evenness of the heat flow to the chip 12, which contributes to a uniform temperature of the chip 12, further reducing mechanical stress in the drip 12.

The stress relief plate 40 is bonded to the tile 10 by means of a first adhesive layer 42 having a first thickness d1, and the chip 12 is bonded to the stress relief plate 40 by means of a second adhesive layer 44 having a second thickness d2 which is substantially smaller than the first thickness d1. In a practical embodiment, the thickness d1 may be in the order of magnitude of tens of microns, for example 40 μm, whereas the thickness d2 may be only in the order of magnitude of several microns, for example 2 μm. As apparent to those skilled in the art, the actual thicknesses are dependent on a large number of parameters, for example the thermal conductivity of the adhesive, the method of application, the contact surface area of the adhesive. The person skilled in the art is deemed able to consider these parameters and select a suitable adhesive with suitable properties, arranged over a suitable contact surface area with a suitable thickness, wherein suitability is determined by the specific application. The specific application is for example inter alia determined by the actual mechanical stress at the actual operating temperature and any artifacts in the droplet formation and dot positioning accuracy occurring due to such mechanical stress.

Thus, when the temperature of the print head changes, the relatively thick first adhesive layer 42 may undergo a shear-deformation and absorb the differential thermal expansion between the tile 10 and the stress relief plate 40. Since the chip 12 and the stress relief plate 40 have approximately the same coefficient of thermal expansion, there will be substantially no differential thermal expansion between these components, so that no substantial mechanical stress will be induced in the chip 12 even when the thickness d2 of the second adhesive layer 44 is selected to be small.

The stress relief plate 40 has a window 46 which provides for fluid communication between the ink supply manifold 36 and the ink supply passages 30 of each printing element.

Due to the presence of the window 46 and due to the limited size of the chip 12, there is only a relatively small area of contact between the stress relief plate 40 and the chip 12. When the heaters 38 are activated for heating the chip 12, the relatively small area of contact tends to limit the heat transfer through the second adhesive layer 44. However, this effect is largely compensated for by the very small thickness d2 of the adhesive layer 44 so that a sufficient heat transfer is achieved even though the adhesive has only a poor heat conductivity.

On the other hand, the relatively large thickness d1 of the first adhesive layer 42 tends to compromise the heat transfer from the tile 10 to the stress relief plate 40, but since the dimensions of the tile 10 and the stress relief plate 40 are larger than those of the chip 12, the area of contact between the tile 10 and the stress relief plate 40, outside the window 46 and the ink supply manifold 36, may be made so large that a sufficient heat transfer can be achieved.

It will be noted that a certain thickness of the stress relief plate 40 is required in order for this plate to function as a stress relief plate. However, the required thickness is significantly smaller than the total thickness of the tile 10. In this example, the thickness of the stress relief plate 40 is less than one third of the thickness of the tile 10 and may be in the same order of magnitude as that of the chip 12. In a practical embodiment, the chip 12 is manufactured by MEMS processing of a silicon wafer. In such embodiment, it may be simple and advantageous to use a silicon wafer with a standard thickness and use a part thereof for forming the stress relief plate 40. Since the costs for the material of the tile 10 are significantly lower than those for the material of the stress relief plate 40, the overall material costs are substantially lower than in a case where the entire tile 10 would have been made of relatively expensive silicon.

It is possible that the tile 10 and the stress relief plate 40 carry only a single MEMS-chip 12. In the example shown in FIG. 2, however, two MEMS-chips 12 are mounted on a common tile and on a common stress relief plate 40. In this case, the area of contact between the tile 10 and the stress relief plate 40 can be made even larger.

In a process of manufacturing a print head according to the invention, the first adhesive layer 42 (or both adhesive layers) may be subjected to a heat treatment, e.g. by heating the adhesive to a temperature above the operating temperature of the print head in the process of applying the adhesive layer and/or in the process of curing the adhesive. In these cases the invention will be advantageous even for a print head which operates at room temperature.

The invention claimed is:

1. A print head, comprising:

a tile made of a material having a first coefficient of thermal expansion (CTE), the tile carrying at least one MEMS-chip that forms a number of printing elements and is in thermal contact with the tile, each MEMS-chip being mainly made of a material having a second CTE different from the first CTE; and a stress relief plate made of a material having a third CTE that is closer to the second CTE than the first CTE is bonded to the tile with a first adhesive layer having a first thickness d1, and each MEMS-chip being bonded to the stress relief plate with a second adhesive layer having a second thickness d2 smaller than the first thickness d1, wherein the at least one MEMS-chip includes a plurality of MEMS-chips, and wherein the stress relief plate extends over and carries the plurality of MEMS-chips and is configured to provide a uniform distribution of heat flow to each of the MEMS-chips.

2. The print head according to claim 1, wherein the stress relief plate is made of the same material as a substrate of each MEMS-chip.

3. The print head according to claim 1, wherein the second thickness d2 of the second adhesive layer is less than half of the first thickness d1 of the first adhesive layer, preferably less than one quarter and more preferably less than one tenth.

4. The print head according to claim 1, wherein the printing elements are ink jet printing elements.

5. The print head according to claim 4, wherein the stress relief plate has a window connecting an ink supply manifold formed in the tile to a plurality of ink supply passages formed in each MEMS-chip, and the second adhesive layer is formed in an area of the stress relief plate surrounding the window.

6. The print head according to claim 4, wherein each of the ink jet printing elements has a flexible membrane arranged to be deflected by means of an actuator.

7. The print head according claim 1, wherein the thickness of the stress relief plate is less than one third of the thickness of the tile.

8. The print head according claim 1, wherein a temperature adjusting device is arranged for direct control of the temperature of the tile.

9. The print head according to claim 8, wherein the stress relief plate has a good thermal conductivity.

10. A method of manufacturing a print head according to claim 1, wherein at least the first adhesive layer is subjected to a heat treatment.

11. The print head according claim 1, wherein the tile further comprises at least one heater for heating a respective MEMS-chip.

12. The print head according to claim 1, wherein a difference in a coefficient of thermal expansion between the chip and the stress relief plate is smaller than a difference in thermal expansion between the stress relief plate and the tile.

* * * * *